US008080747B2

(12) United States Patent
Wang et al.

(10) Patent No.: US 8,080,747 B2
(45) Date of Patent: Dec. 20, 2011

(54) MECHANICAL INTERLOCK BETWEEN TWO ELECTRICAL DEVICES

(75) Inventors: Haiyuan Wang, Xi'an (CN); Yali Zhang, Shanyang County (CN)

(73) Assignee: Zhejiang Chint Electrics Co., Ltd, Wenshou (CN)

( * ) Notice: Subject to any disclaimer, the term of this patent is extended or adjusted under 35 U.S.C. 154(b) by 63 days.

(21) Appl. No.: 12/526,781

(22) PCT Filed: Feb. 4, 2008

(86) PCT No.: PCT/CN2008/000301

§ 371 (c)(1),
(2), (4) Date: Aug. 11, 2009

(87) PCT Pub. No.: WO2008/098481

PCT Pub. Date: Aug. 21, 2008

(65) Prior Publication Data

US 2010/0044192 A1 Feb. 25, 2010

(30) Foreign Application Priority Data

Feb. 12, 2007 (CN) ..... 2007 1 0003597

(51) Int. Cl.
*H01H 1/20* (2006.01)

(52) U.S. Cl. ..... 200/50.32; 335/120

(58) Field of Classification Search ..... 200/50.32, 200/50.33, 50.37; 335/160, 120
See application file for complete search history.

(56) References Cited

U.S. PATENT DOCUMENTS 6,002,579 A * 12/1999 Drexler et al. ..... 361/605

* cited by examiner

*Primary Examiner* — Vanessa Girardi
(74) *Attorney, Agent, or Firm* — Fenwick & West L.L.P

(57) ABSTRACT

A low voltage electrical appliance having a mechanical interlock means comprises at least two contactors, wherein every contactor includes a base (11, 21), a support (12, 22), a top cover (4) and a contact holding sliding part (13, 23) in the base. Two contactors which are arranged in parallel both have one mechanical interlock means, which includes an interlocking element (3). The shaft of the interlocking element (3) may rotate in the slot of the base (11, 21). By the swinging of the interlocking element (3), a tang of the interlocking element (3) extends into the locking aperture of the contact holding sliding part, thereby preventing the energization action of the contact holding sliding part.

9 Claims, 4 Drawing Sheets

MECHANICAL INTERLOCK BETWEEN TWO ELECTRICAL DEVICES

This application is the National Stage of International Application No. PCT/CN2008/000301, filed Feb. 4, 2008, and claims the benefit of CN Application No. 200710003597.5, filed on Feb. 12, 2007, both of which are incorporated by reference in their entirety.

TECHNICAL FIELD

The present invention relates to a low voltage electrical appliance, particularly to a snap-fitted low voltage electrical appliance allowing for mechanical interlocking of two or more appliances mounted in parallel so that the appliances snap-fitted in parallel cannot be closed simultaneously.

BACKGROUND ART

In the extensively used snap-fitted low voltage electrical appliances such as a reversible contactor group composed of two contactors, for the sake of normal and safe operation thereof, a mechanical interlocking function is required between the two contactors, i.e., when any one of the two contactors is in an energized state, the other contactor cannot be energized, i.e., it is locked in a disconnected state.

In a multi-loop circuit system, an electrical appliance group made of over two snap-fitted electrical appliances is needed. To ensure normal and safe operation of the appliance group, a mechanical interlocking function is required between the appliances, that is to say, at the same time only one of the appliances is allowed to be energized whereas the remaining adjacent two appliances are locked in a disconnected state.

Taking contactors as an example, currently the commonly used interlock type contactor group comprises two individual contactors and one interlock means. The prior-art interlock means has a relatively complicated structure with too many components and occupies too much space.

The Chinese utility model patent ZL200520026452.3 discloses a technology regarding a mechanical interlocking module of a reversible AC contactor. The mechanical interlocking module comprises a housing, a ram head-shaped interlocking member, two push rods and two contact holders. Each of the contact holders is provided with a screw rod fixedly coupled to the push rod and a bridge-like contact. The two push rods respectively abut against left and right ram horns of the ram head-shaped interlocking member. An internally threaded insert mating with the screw rod is fixedly connected to each of the contact holders. Such mechanical interlocking module in the prior art has a working principle as follows: the two contact holders are allowed by the internally threaded inserts on the two contact holders to bring the screw rod into motion, further urge the push rods which in turn push the left and right ram horns of the ramhead-shaped interlocking member into a locked position, thereby accomplishing the interlocking function.

The prior art appliance requires a large number of components and therefore leads to issues such as difficult manufacturing, a high processing cost and a large size. Furthermore, each of the contactors in the contactor group cannot be used as an independent contactor, or vice versa, independent contactors cannot be combined into a contactor group, i.e., free combination and mutual interlocking of two or more contactors cannot be fulfilled. All the above give too many limitations to the application of that technology.

SUMMARY OF THE INVENTION

An object of the present invention is to provide a low voltage electrical appliance having a mechanical interlock means, which can be either freely combined or independently used, so that the drawbacks in the aforesaid prior art can be overcome.

According to one aspect of the present invention, the low voltage electrical appliance can be used as a low voltage electrical appliance group combined from two electrical appliances arranged in parallel, wherein when any one of the electrical appliances is in an energized state, the other electrical appliance is locked in a disconnected state and cannot be energized. The present invention can also be used for an electrical appliance group combined from more than two snap-fitted electrical appliances, wherein when any one of the electrical appliances is in an energized state and the adjacent appliances are all locked in a disconnected state.

To at least realize the above object of invention, the low voltage electrical appliance having a mechanical interlock means according to one aspect of the present invention adopts the following technical solution.

The low voltage electrical appliance according to one aspect of the present invention comprises at least two identically constructed low voltage electrical appliances, wherein each of the appliances comprises a support, a base located above the support, a top cover and a contact holding sliding part reciprocatedly mounted in the base. Every two electrical appliances which are arranged in parallel are controlled by a mechanical interlock means so as to prevent the contact holding sliding parts of the parallel appliances from being closed simultaneously. In said mechanical interlock means, a swingable interlocking element is disposed on the base; a pivot shaft is disposed on the interlocking element to pivotally couple it to said base so that the interlocking element can swing about said pivot shaft; an inner tang and an outer tang are formed on said interlocking element; each of the tangs has an end face at the end thereof; an inner locking aperture is form in a side wall of the contact holding sliding part of each of the electrical appliances adjacent to the interlocking element; an outer locking aperture is formed in a side wall face on the side of the contact holding sliding part of each of the electrical appliances away from the interlocking element; a through hole 28 is formed in a first outside wall 202 of the base; a through slot 103 and an aperture 108 in communication with the slot 103 are formed in a second outside wall 102 of the base. When at least two low-voltage electrical appliances with the same construction are arranged in parallel, the inner tang and the outer tang of the interlocking element can swing in the through slot 103 so that the inner tang 32 can extend into the inner locking aperture 17 of the contact holding sliding part of at least one electrical appliance and the outer tang 33 of the interlocking element 3 of the electrical appliance can extend out and then into the outer locking aperture 27 of the contact holding sliding part of the other electrical appliance; the structural parameters of the mechanical interlock means and the contact holding sliding part of each of the electrical appliances should satisfy the following formula:

$$L>H$$

$$d1+d2>L-H$$

where,

L represents the distance between two end faces 321 and 331 of the inner tang 32 and the outer tang 33 of the interlocking element 3;

H represents the distance between two side wall surfaces 131 and 231 of the two contact holding sliding parts 13 and 23;

d1 represents the gap in which the end face 321 of the inner tang 32 can freely swing in the inner locking aperture; and d2 represents the gap in which the end face 331 of the outer tang 33 can freely swing in the outer locking aperture.

Two semi-circular curved surfaces 104 and 105 are formed on the upper portions of two sidewalls of the slot 103 of the base, and the pivot shaft 31 of the interlocking element 3 hangs on the semi-circular curved surfaces 104 and 105 so that it can rotate in the semi-circular curved surfaces 104 and 105.

In both lateral edges of each of the supports of the electrical appliances are formed connecting troughs in communication with the bottom surface of the electrical appliances. By a matched connection of a universal U-shaped connecting member and the connecting troughs pre-formed on the supports in a manner that the U-shaped connecting member is inserted in a straddling manner into the connecting troughs on the support, the two parallel electrical appliances are combined and connected together from the lower end and more than two contactors are combined into a contactor group. The upper ends of the parallel electrical appliances are covered and fixed by one top cover or two divided top covers.

The inner tang 32 and the outer tang 33 of the interlocking element 3 respectively have an acting face 326, 336 which are respectively in sliding contact with a sliding face 132, 232 in the inner locking aperture 17 and the outer locking aperture 27 of the contact holding sliding parts. The acting faces 326, 336 are respectively smoothly joined to the end faces 321, 331 of the inner tang 32 and the outer tang 33 via a circular arc.

The side wall faces 131, 231 of the contact holding sliding parts 13, 23 of the electrical appliances are respectively smooth joined to the sliding face 132 in the inner locking aperture 17 thereon and the sliding face 232 in the outer locking aperture 27 via a circular arc.

The low-voltage electrical appliance according to the present invention exhibits advantages such as a simple construction, easy manufacturing, a low production cost, a small size, extensive use, convenient operation and use and excellent interlocking reliability, and solves the issues in the prior art electrical appliances that independently useable electrical appliances cannot be freely combined into an electrical appliance group with an interlocking function or the group, after being combined, cannot effect reliable interlocking.

BRIEF DESCRIPTION OF THE ACCOMPANYING DRAWINGS

DETAILED DESCRIPTION OF PREFERRED EMBODIMENTS

The technical solution according to an embodiment of the present invention is described in detail with reference to the accompanying drawings by taking the contactor as an example.

Figure 1:
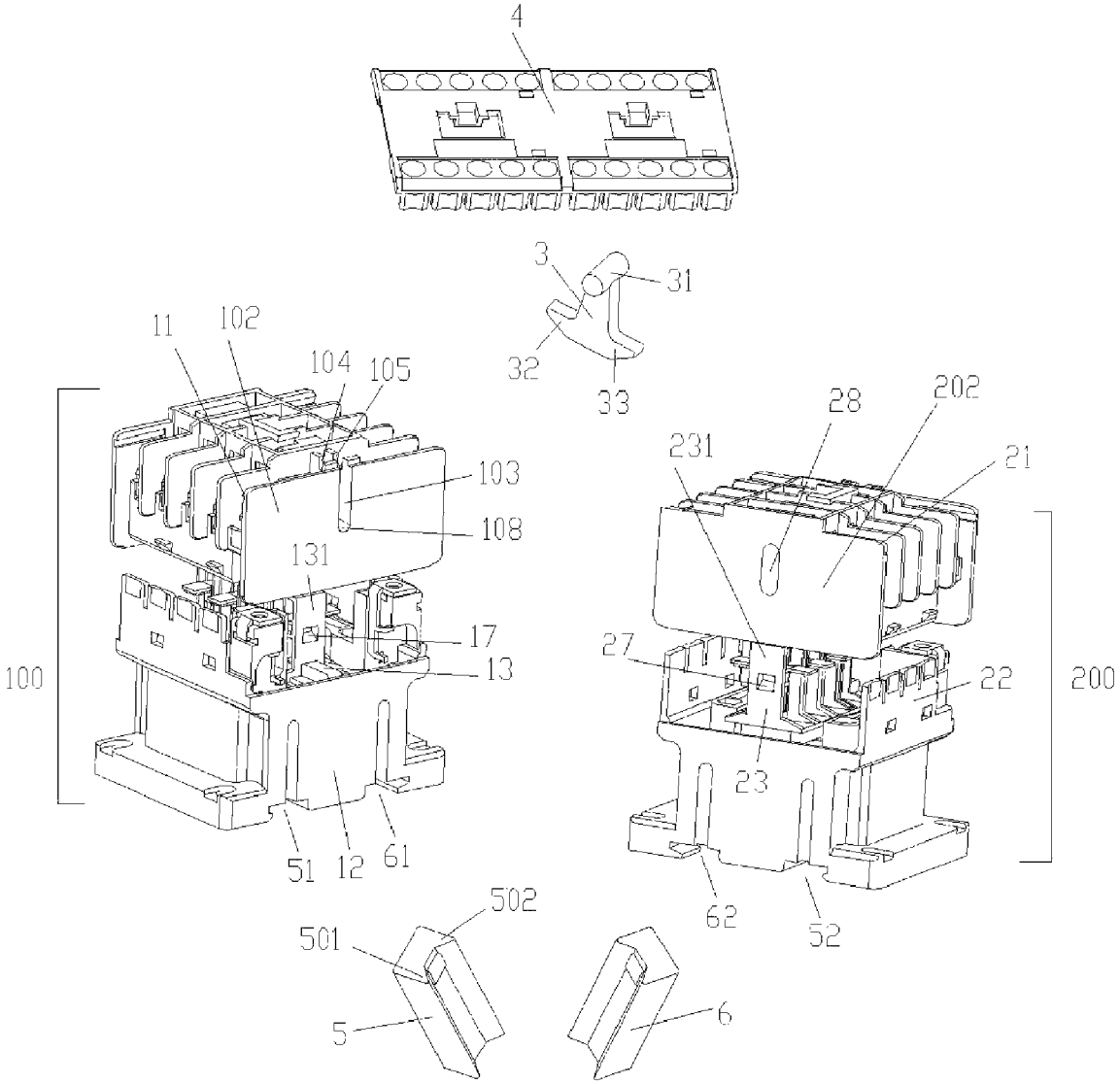
FIG. 1 is a structural schematic view of a contactor group according to an embodiment of the present invention.

According to an embodiment of the present invention as shown in FIG. 1, a contactor having an interlock means comprises two exactly identical contactors 100 and 200. For a clear illustration purpose, the contactor 100 is hereinafter referred to as a proper contactor and the contactor 200 is hereinafter referred to as an adjacent contactor.

Figure 2:
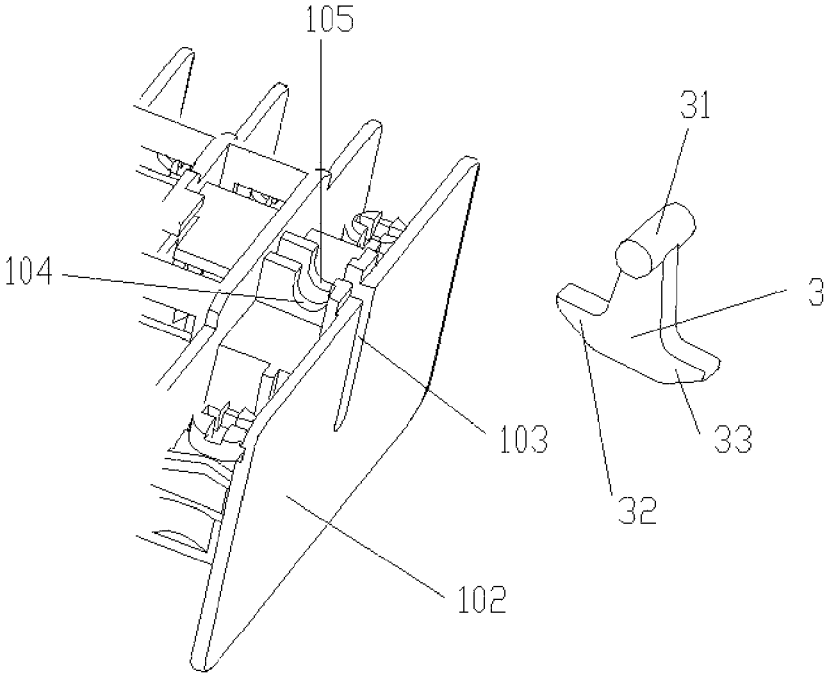
FIG. 2 is a perspective view of a mechanical interlock means of the contactor group according to an embodiment of the present invention.

As shown in FIGS. 1 and 2, the proper contactor 100 and the adjacent contactor 200 both include a support 12, 22, a base 11, 21 located above the support, a top cover 4 and a contact holding sliding part 13, 23 reciprocatedly mounted in the base. Every two contactors which are arranged in parallel are controlled by a mechanical interlock means so as to prevent the contact holding sliding parts of the parallel contactors from being closed simultaneously. In said mechanical interlock means, a swingable interlocking element 3 is disposed on the base 11, 21. A pivot shaft 31 is disposed on the interlocking element 3 to pivotally couple it to said base 11, 21 so that the interlocking element 3 can swing about said pivot shaft 31. An inner tang 31 and an outer tang 33 are formed on said interlocking element 3. An inner locking aperture 17 is provided on a side wall surface 131 of the contact holding sliding part of each of the contactors adjacent to the interlocking element 3. An outer locking aperture 27 is provided on the other side wall surface 231 of the contact holding sliding part of each of the contactors away from the interlocking element 3. A through hole 28 is formed in a first outside wall 202 of the base 11, 21. A through slot 103 and an aperture 108 in communication with the slot 103 are formed in a second outside wall 102 of the base 11, 21. When at least two contactors with the same construction are arranged in parallel, the inner tang 32 and the outer tang 33 of the interlocking element 3 can swing in the through slot 103 so that the inner tang 32 can extend into the inner locking aperture 17 of the contact holding sliding part 13 of the contactor 100 and the outer tang 33 of the interlocking element 3 of the contactor can extend out of the base housing of the contactor 100 into the outer locking aperture 27 of the contact holding sliding part 23 of the adjacent contactor 200, whereby only one of the contactors are permitted to be energized at the same time and the remaining contactors in parallel are disconnected so as to achieve the interlocking effect.

Figure 5:
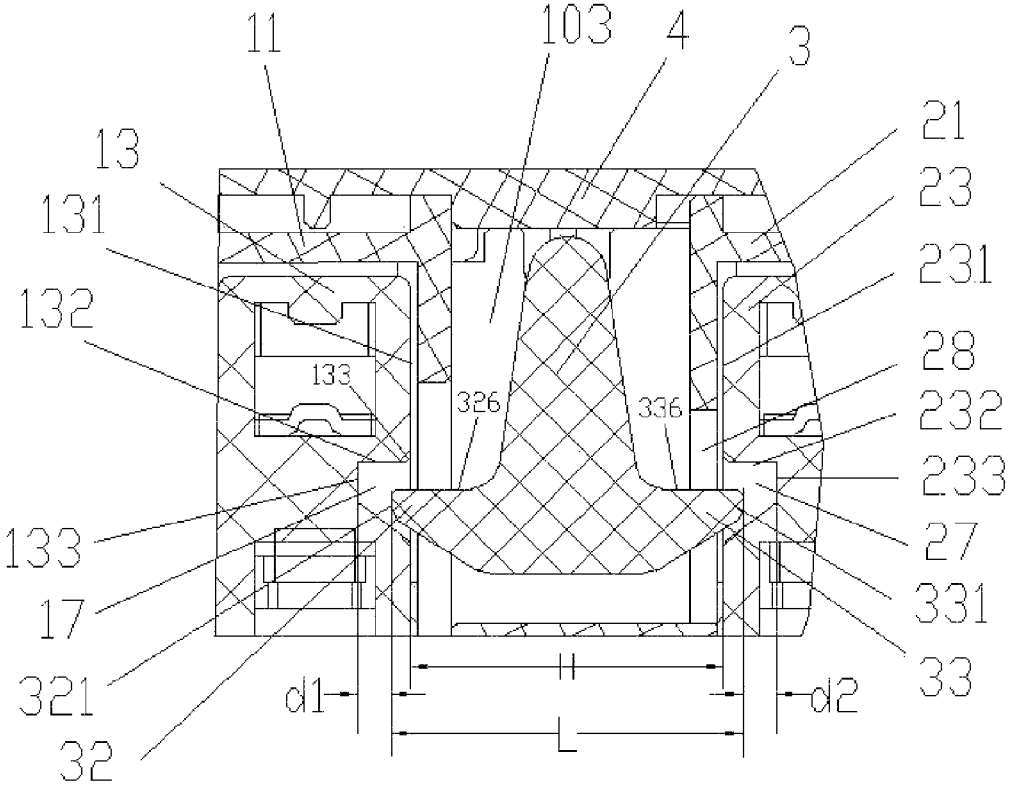
FIG. 5 is a partially enlarged view of FIG. 4.

As shown in FIGS. 1, 2 and 5, each of the contactor bases 11, 21 is formed with the slot 103 (not shown in the adjacent contactor 200). Two semi-circular curved surfaces 104 and 105 are formed on the upper portions of two sidewalls of the slot 103, and the pivot shaft 31 of the interlocking element 3 hangs on the semi-circular curved surfaces 104 and 105 for pivotal connection so that the inner tang 32 and the outer tang 33 of the interlocking element 3 can swing in the slot 103. The through hole 28 is formed in a first outside wall 202 of the base 11, 21 (the through hole 28 not shown in the contactor 100), and the slot 103 is through between two ends. The aperture 108 in communication with the slot 103 is formed in the second outer sidewall 102 of each of the bases 11 and 21 such that the outer tang of the interlocking element extends out of the base housing of the proper contactor through said aperture. The inner locking aperture 17 (not shown in the contact holding sliding parts 23) is formed in one side of each of contact holding sliding parts 13 and 23 of the contactors adjacent to the interlocking element in a manner that the aperture can receive the inner tang 32 on the interlocking element 3 so that the inner tang 32 can extend into the inner locking aperture 17 of the contact holding sliding part 3 of the proper contactor 100 and cooperate therewith to complete the locking of the contact holding sliding part 13. The outer locking aperture 27 (not shown in the contact holding sliding parts 13) is formed in one side of each of contact holding sliding parts of the contactors away from the interlocking element 3 in a manner that the aperture can receive the outer tang 33 of the interlocking element 3 so that the outer tang 33 can extend out of the base housing of the proper contactor 100 and into the outer locking aperture 27 of the contact holding sliding part 23 of the adjacent contactor 200 and cooperate therewith to complete the locking of the contact holding sliding part 23.

Figure 3:
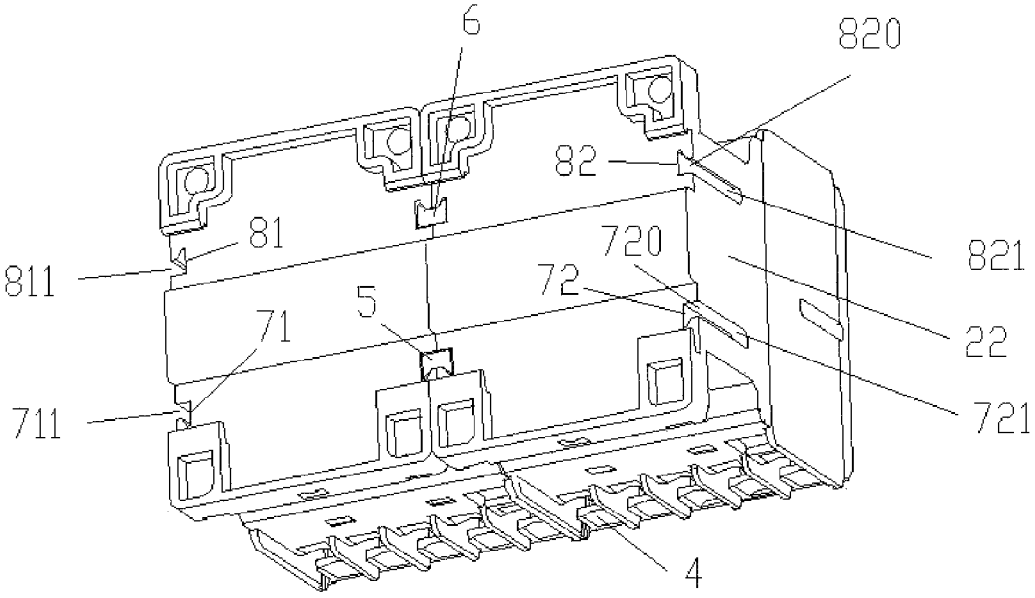
FIG. 3 is a perspective view of the appearance of the combined contactor group according to an embodiment of the present invention.

As shown in FIGS. 1 and 3, in both lateral edges of each of the supports 12, 22 of the contactors are provided connecting troughs 51, 61, 71, 81; 52, 62, 72, 82. A U-shaped connecting member 5 is inserted into the connecting troughs 51 and 52 in a straddling manner, and a U-shaped connecting member 6 is also inserted into the connecting troughs 61 and 62 in a straddling manner so as to connect and combine the contactor 100 and the adjacent contactor 200 together. The connecting troughs 71, 81 in the support 12 are connecting interfaces for combining the contactor 100 with other adjacent contactors (not shown); the connecting troughs 72, 82 in the support 22 are connecting interfaces for combining the contactor 200 with other adjacent contactors (not shown). As seen from the above, more than two connectors can be combined into a contactor group by means of the universal U-shaped connecting member 5 (or 6) and the connecting troughs pre-formed in the supports. Said U-shaped connecting member has a U-shaped cross section, and protrusions 501, 502 on both sides of the U shape are in a semi-dovetail (see FIG. 1) or L-shaped configuration. The connecting troughs in the bottom surface of the support are semi-dovetail shaped or L-shaped semi-bores which are provided with openings 720, 820, 811, 711 (as shown in FIG. 3) in the edges of the bottom surface of the support. The openings of the semi-bores extend along the depth of the semi-holes so as to form slots 721, 821 in the side surface of the support (as shown in FIG. 3). The two semi-dovetail shaped or L-shaped protrusions of the U-shaped connecting member are inserted in a straddling manner into the semi-dovetail shaped or L-shaped semi-bores of the connecting troughs of the two contactors to combine the two contactors together.

Each of said contactors can be used as a proper contactor for connection to and combination with adjacent contactors in parallel.

Figure 4:
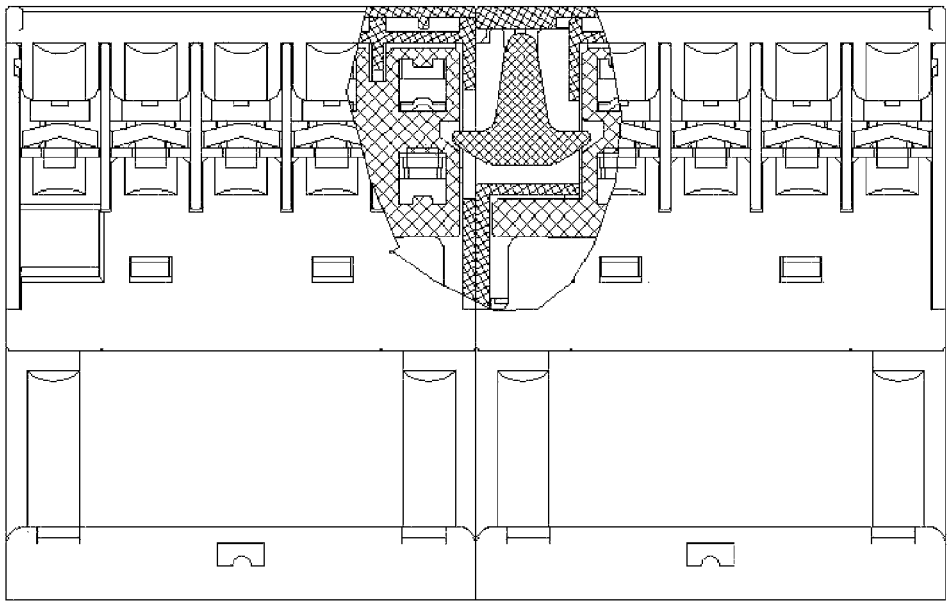
FIG. 4 is a sectional view of a mechanical interlock means of the contactor group according to an embodiment of the present invention.

As shown in FIGS. 4 and 5, when the contactors are both in a disconnected state, the interlocking element 3 is in a centered position, the inner tang 32 and the outer tang 33 can respectively freely extend into the inner locking apertures 17 and the outer locking apertures 27. A distance L between two end faces 321 and 331 of the inner tang 32 and the outer tang 33 of the interlocking element is greater than a distance H between two side wall surfaces 131 and 231 on the two contact holding sliding parts 13 and 23. In this state, the inner tang 32 and the outer tang 33 are respectively not in contact with the contact holding sliding parts 13 and 23. In this case, the inner tang 32 and the outer tang 33 can respectively freely swing in the inner locking aperture 17 and the outer locking aperture 27 with a gap d1 and d2, as shown in the embodiment of FIG. 5, wherein d1 and d2 respectively represent the distances between two end faces 321 and 331 of the inner tang 32 and the outer tang 33 and the aperture bottom surfaces 133 and 233 of the inner locking aperture 17 and the outer locking aperture 27. To ensure normal operation and interlocking of the contactor group, the above parameters should satisfy the following conditions:

$$L>H \text{ and } d1+d2>L-H,$$

where,

L represents the distance between two end faces 321 and 331 of the inner tang 32 and the outer tang 33 of the interlocking element 3;

H represents the distance between two side wall surfaces 131 and 231 of the two contact holding sliding parts 13 and 23;

d1 represents the gap in which the end face 321 of the inner tang 32 can freely swing in the inner locking aperture;

d2 represents the gap in which the end face 331 of the outer tang 33 can freely swing in the outer locking aperture.

The working procedure of the embodiment of present invention is described as follows by taking interlocking contactors as example.

Figure 6:
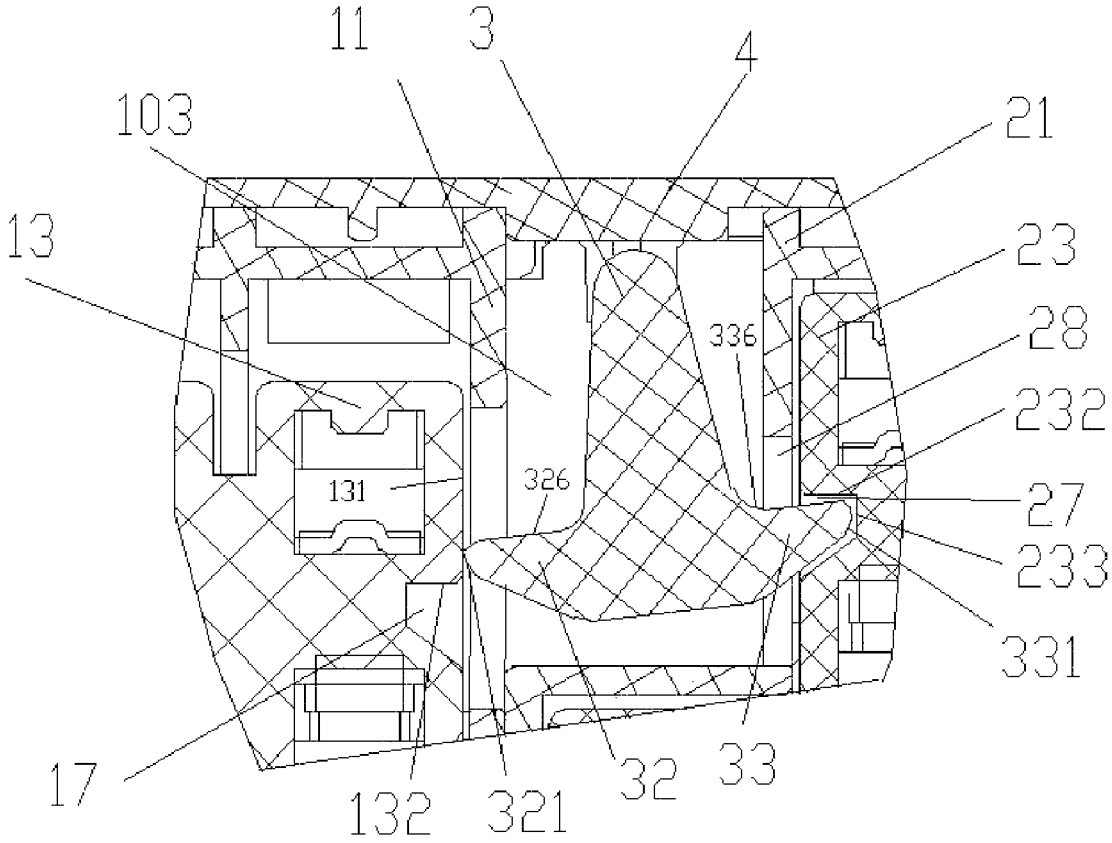
FIG. 6 is a sectional view showing the structure of the contactor group according to an embodiment of the present invention in a locked state.

As shown in FIG. 5, the contact holding sliding part 13 of the proper contactor 100 moves downward under an operating force when the proper contactor 100 is first energized. Since the condition L>H is satisfied, a sliding face 132 in the inner locking aperture 17 and a side wall surface 131 on the contact holding sliding part 13 push the inner tang 32 to enable the interlocking element 3 to swing towards the adjacent contactor 200. When the inner tang 32 is completely pushed out of the inner locking aperture 17, the side wall surface 131 of the contact holding sliding part 13 is allowed to abut against the end face 321 of the inner tang 32 of the interlocking element 3 (the state as shown in FIG. 6). Since the above parameters satisfy the condition d1+d2>L−H, while the interlocking element 3 swings towards the adjacent contactor 200, its outer tang 33 can freely extend into the outer locking aperture 27 of the adjacent contactor 200 all the time to ensure the normal energization operation of the proper contactor.

As shown in FIG. 6, when the proper contactor 100 is in an energized state, since the side wall surface 131 of the contact holding sliding part 13 of the proper contactor 100 is allowed to abut against the end face 321 of the inner tang 32 of the interlocking element 3, the interlocking element 3 cannot swing towards the proper contactor 100, whereby the outer tang 33 of the interlocking element 3 blocks the downward movement of a sliding face 232 in the outer locking aperture 27 of the adjacent contactor, that is, the contact holding sliding part 23 of the adjacent contactor is caused not to move downwardly, so that the adjacent contactor 200 is locked and cannot be energized.

The interlocking procedure in which the adjacent contactor 200 is energized first and the proper contactor cannot be energized is described as follows:

As shown in FIG. 5, when the adjacent contactor 200 is first energized, the contact holding sliding part 23 thereof moves downward under an operating force. Since the above parameters satisfy with the condition L>H, a sliding face 232 in the outer locking aperture 27 and a side wall surface 231 on the contact holding sliding part 23 push the outer tang 33 to enable the interlocking element 3 to swing towards the proper contactor 100. When the outer tang 33 is completely pushed out of the outer locking aperture 27, the side wall surface 231 of the contact holding sliding part 23 is allowed to abut against the end face 331 (not shown) of the outer tang 33 of the interlocking element 3. Since the above parameters satisfy the condition d1+d2>L−H, while the interlocking element 3 swings towards the proper contactor 100, its inner tang 32 can freely extend into the inner locking aperture 17 of the proper contactor 100 all the time to ensure the normal energization operation of the adjacent contactor 200. When the adjacent contactor 200 is in an energized state, since the side wall surface 231 of the contact holding sliding part 23 of the adjacent contactor 200 is allowed to abut against the end face 331 of the outer tang 33 of the interlocking element 3, the interlocking element 3 cannot swing towards the adjacent contactor 200, whereby the inner tang 32 of the interlocking element 3 blocks the downward movement of a sliding face 132 in the inner locking aperture 17 of the proper contactor 100, that is, the contact holding sliding part 13 of the proper contactor 100 is caused not to move downwardly, so that the proper contactor 100 is locked and cannot be energized.

Referring to FIG. 2, the pivot shaft 31 of the interlocking element 3 is disposed on the two semi-circular curved surfaces 104 and 105 on the base, and a contact surface (not shown) of the top cover 4 and the semi-circular curved surfaces 104 and 105 jointly constitute a structure constraining the pivot shaft 31 from disengagement and allowing it for flexible pivoting. Therefore, when the top cover 4 is opened, the interlocking element 3 can be easily mounted and detached so that the interlocking element 3 can be used as a universal element configured and mounted and detached in production and use according to practical uses. According to the technical solution of the embodiment of the present invention, the technical difficulty about interchange use of an independently used contactor and a contactor for use in a contactor group is solved, which does prominent contribution to reduction of costs of production and use.

As shown in FIG. 5, the inner tang 32 of the interlocking element 3 has an acting face 326 which is smoothly joined to the end face 321 of the inner tang 32 via a circular arc. The outer tang 33 of the interlocking element 3 has an acting face 336 which is smoothly joined to the end face 331 of the outer tang 33 via a circular arc. The acting faces 326 and 336 respectively act with the sliding faces 132 and 232 of the inner locking aperture 17 and the outer locking aperture 27. When the proper contactor 100 goes through an energization operation, the sliding face 132 in the inner locking aperture 17 first pushes the acting face 326 to enable the interlocking element 3 to swing towards the adjacent contactor 200. When the proper contactor 100 is first in an energized state, the acting face 336 blocks the sliding face 232 so that the contact holding sliding part 23 of the adjacent contactor 200 cannot make an energizing action. When the adjacent contactor 200 goes through an energization operation, the sliding face 232 in the outer locking aperture 27 first pushes the acting face 336 to enable the interlocking element 3 to swing towards the proper contactor 100. When the adjacent contactor is first in an energized state, the acting face 326 blocks the sliding face 132 so that the contact holding sliding part 13 of the proper contactor 100 cannot make an energizing action. As seen from the above, the end faces of the inner tang 32 and the outer tang 33 are smoothly joined to the acting faces via smooth circular arcs, which helps improve the operation performance.

The sliding face 132 in the inner locking aperture 17 is smoothly joined to the side wall face 131 of the contact holding sliding part 13 via a circular arc, and the sliding face 232 in the outer locking aperture 27 is smoothly joined to the side wall face 231 of the contact holding sliding part 23 via a circular arc. The smooth joining also helps improve the operation performance.

The technical ideas of the present invention are not limited to the above-mentioned detailed embodiments in the description. For example, a contactor group having a mechanical interlock means and comprising more than two contactors is provided according to the embodiment of the present invention, wherein all of the contactors are the same, the number of contactors for combination can be set according to practical use and needs, and the combined contactor group exhibits an interlocking function as follows: when any one of the contactors is first energized, the adjacent contactors on both sides thereof are all locked in a disconnected state and cannot be energized. Herein, the pivot shaft 31 can also disposed on the two side walls of the slot 103 of each of the bases, the semi-circular curved face is provided on the interlocking element 3 in a hook shape such that the interlocking element 3 pivotally hangs on the pivot shaft on the slot 103 via the hook-shaped semi-circular curved face so that the interlocking element 3 can freely swing in the slot 103.

According to a contactor group having a mechanical interlock means according to the embodiment of the present invention, each of the contactors can be used as an independent contactor, whereupon the interlock means thereon does not affect the normal manipulation, operation and use of the contactor. That is to say, the same contactor product manufactured as per the technical solution of the present invention can either used as an independent contactor or used for combination with other contactors to form a contactor group with an interlocking function. This technical feature of the present invention is of great significance in reducing the production costs and improving the production efficiency.

In each of the contactors in the contactor group having a mechanical interlock means according to the present invention, the support can be made integral, or the base can be made integral or the top cover can be made integral so as to form an inseparable entirety between the contactors.

Although the description is described by taking the contactor as an example, it is appreciated by a person skilled in the art that the present invention is obviously not merely adapted for contactors but also for other snap-fitted low-voltage electrical appliances such as devices like a breaker or switch.

What is claimed is:

1. A low voltage electrical appliance having mechanical interlock means, comprising at least two identically constructed low voltage electrical appliances, wherein each of the appliances comprises a support, a base located above the support, a top cover and a contact holding sliding part reciprocatedly mounted in the base, characterized in that:

every two electrical appliances which are arranged in parallel are controlled by a mechanical interlock means so as to prevent the contact holding sliding parts (13, 23) of the parallel appliances from being closed simultaneously, in said mechanical interlock means, a swingable interlocking element (3) is disposed on the base (11, 21), a pivot shaft (31) is disposed on the interlocking element (3) to pivotally couple it to said base (11, 21) so that the interlocking element (3) can swing about said pivot shaft (31);

an inner tang (32) and an outer tang (33) are formed on said interlocking element (3), each of the inner tang (32) and the outer tang (33) has an end face (321, 331) at the end thereof;

an inner locking aperture (17) is formed in a side wall face (131) on the side of the contact holding sliding part (13, 23) adjacent to the interlocking element (3), an outer locking aperture (27) is formed in a side wall face (231) on the side of the contact holding sliding part (13, 23) away from the interlocking element (3), and each of the inner locking aperture (17) and the outer locking aperture (27) is formed with a sliding face (132, 232) therein;

a through hole (28) is formed in a first outside wall (202) of the base; a through slot (103) and an aperture (108) in communication with the slot (103) are formed in a second outside wall (102) of the base; when at least two low-voltage electrical appliances with the same construction are arranged in parallel, the inner tang and the outer tang of the interlocking element can swing in the through slot (103) so that the inner tang (32) can extend into the inner locking aperture (17) of the contact holding sliding part (13) of the appliance (100) and the outer tang (33) of the interlocking element (3) of the electrical appliance can extend out of a base housing of the electrical appliance (100) and then into the outer locking aperture (27) of the contact holding sliding part (23) of the adjacent electrical appliance (200);

the structural parameters of the mechanical interlock means and the contact holding sliding part of each of the electrical appliances satisfy the following formula:

$$L>H \text{ and}$$

$$d1+d2>L-H$$

where,

L represents the distance between two end faces (321, 331) of the inner tang (32) and the outer tang (33) of the interlocking element (3);

H represents the distance between two side wall surfaces (131, 231) of the two contact holding sliding parts (13, 23);

d1 represents a gap in which the end face (321) of the inner tang (32) can freely swing in the inner locking aperture; and d2 represents a gap in which the end face (331) of the outer tang (33) can freely swing in the outer locking aperture;

further characterized in that: on both lateral edges of bottom surface of the supports (12, 22) of each of the electrical appliances are provided at least one connecting trough, the shape of the cross section of the connecting trough parallel to the bottom surface of the supports (12, 22) is a semi-dovetail shaped or L-shaped semi-bore which has an opening in the bottom surface edge of the support (12, 22), said opening extends along depth of the semi-bore so as to form a slot (721), so that more than two appliances are combined into an appliance group by a matched connection of a U-shaped connecting member (5, 6) and the connecting trough.

2. The low voltage electrical appliance having mechanical interlock means according to claim 1, characterized in that: said V-shaped connecting member (5) has a V-shaped cross section, and protrusions (501, 502) on both sides of the V-shaped connecting member are in a semi-dovetail or L-shaped configuration, the semi-dovetail or L shape conforms to the semi-dovetail shape or L shape of the connecting trough in the bottom surface of the low voltage electrical appliance so that the two semi-dovetail shaped or L-shaped protrusions of the V-shaped connecting member (5) are inserted in a straddling manner into the connecting troughs formed of the semi-dovetail shaped or L-shaped semi-bores of the two parallel electrical appliances, thereby combining the two electrical appliances together from the lower end.

3. The low voltage electrical appliance having mechanical interlock means according to claim 1, characterized in that: each of the inner tang (32) and the outer tang (33) of the interlocking element (3) has an acting face (326, 336), the acting faces (326, 336) are respectively in sliding contact with sliding faces (132, 232) in the inner locking aperture (17) and the outer locking aperture (27) of the contact holding sliding parts, and the acting faces (326, 336) are respectively smoothly joined to the end faces (321, 331) of the inner tang (32) and the outer tang (33) via a circular arc.

4. The low voltage electrical appliance having mechanical interlock means according to claim 1, characterized in that: the side wall faces (131, 231) of the contact holding sliding parts (13, 23) of each of the electrical appliances are respectively smoothly joined to the sliding face (132) in the inner locking aperture (17) thereon and the sliding face (232) in the outer locking aperture (27) thereon via a circular arc.

5. The low voltage electrical appliance having mechanical interlock means according to claim 1, characterized in that: the bases (11, 21), supports (12, 22) or top covers of the parallel electrical appliances can be respectively produced as an integral base, support or top cover.

6. The low voltage electrical appliance having mechanical interlock means according to claim 1, characterized in that: the interlocking element (3) can be configured as needed, so that after the top cover (4) is opened, the interlocking element (3) can be easily mounted and detached, and each of the electrical appliances from which the interlocking element (3) is detached can be independently used, and in that upon independent use, the interlock means on the electrical appliance does not affect the normal working thereof.

7. The low voltage electrical appliance having mechanical interlock means according to claim 1, characterized in that: the end faces (321, 331) at the ends of the inner tang and the outer tang are arc shaped.

8. The low voltage electrical appliance having mechanical interlock means according to claim 1, characterized in that: two semi-circular curved surfaces (104, 105) are formed on the upper portions of two sidewalls of the slot (103) of the base (11, 21), and the interlocking element (3) is pivotally mounted on the semi-circular curved surfaces (104, 105) via the pivot shaft (31) and can swing in the slot (103) freely;

when the two parallel electrical appliances are both in a disconnected state, the inner tang (32) and the outer tang (33) of the interlocking element (3) can respectively freely extend into the inner locking aperture (17) of the electrical appliance (100) and the outer locking aperture (27) of the adjacent electrical appliance (200);

when one electrical appliance (100) is first energized, an operating force drives the contact holding sliding part (13) thereof to move downwardly, bring the sliding face (132) in the inner locking aperture (17) thereon to move downwardly, the sliding face (132) urging the inner tang (32) on the electrical appliance (100) away from the inner locking aperture (17), so that the interlocking element (3) swings towards the adjacent electrical appliance (200), whereby the outer tang (33) completely extends into the outer locking aperture (27) of the adjacent electrical appliance (200) so as to prevent the contact holding sliding part (23) of the adjacent electrical appliance (200) from moving downwardly and lock the adjacent electrical appliance (200) in a disconnected state.

9. The low voltage electrical appliance having mechanical interlock means according to claim 8, characterized in that: the pivot shaft (31) is disposed on the two side walls of the slot (103) of the base, a semi-circular curved face is provided on the interlocking element (3) in a hook shape such that the interlocking element (3) pivotally hangs on the pivot shaft on the slot (103) via the hook-shaped semi-circular curved face so that the interlocking element (3) can freely swing in the slot (103).

* * * * *